United States Patent [19]

Guthrie, Jr.

[11] Patent Number: 5,058,524

[45] Date of Patent: Oct. 22, 1991

[54] DEVICE FOR LOCATING LOST SKIS IN POWDER SNOW

[76] Inventor: John T. Guthrie, Jr., 3673 Atlas Way, West Valley City, Utah 84120

[21] Appl. No.: 642,513

[22] Filed: Jan. 17, 1991

[51] Int. Cl.[5] ..... G08B 5/00; A63C 11/00

[52] U.S. Cl. ..... 116/209; 224/220; 224/267; 280/637

[58] Field of Search ..... 116/209, 210, DIG. 11; 280/637, 809; 441/68, 75; 224/220, 267, 901, 917

[56] References Cited

U.S. PATENT DOCUMENTS

| | | | |
|---|---|---|---|
| 2,933,324 | 4/1960 | Stimler | 280/809 |
| 4,240,371 | 12/1980 | Perry | 116/210 |
| 4,548,375 | 10/1985 | Moss | 248/205.2 |
| 4,919,452 | 4/1990 | Cimino | 280/809 |

FOREIGN PATENT DOCUMENTS

| | | | |
|---|---|---|---|
| 2383682 | 11/1978 | France | 280/637 |
| 89/04194 | 5/1989 | World Int. Prop. O. | 280/809 |

*Primary Examiner*—William A. Cuchlinski, Jr.
*Assistant Examiner*—W. Morris Worth
*Attorney, Agent, or Firm*—Mallinckrodt & Mallinckrodt

[57] ABSTRACT

A long colored ribbon streamer is bundled preferably in zig-zag fashion in and transversely of the length of an envelope adapted to be releasibly fastened to an upper surface of a ski when skiing in deep powder snow. An end of the streamer is adapted to be fastened to the ski when skiing in the deep powder, while the envelope itself is adapted to be fastened to the skier usually through his or her ski boot. A fall in the snow that releases the ski boot and skier from the ski will cause the streamer to trail the ski at the surface of the snow that covers the ski, thereby revealing the ski's location to the skier.

7 Claims, 2 Drawing Sheets

DEVICE FOR LOCATING LOST SKIS IN POWDER SNOW

BACKGROUND OF THE INVENTION

1. Field

The invention is in the field of devices used while skiing for locating a ski that automatically disengages a ski boot as a result of a fall by the skier and becomes lost under powder snow.

2. State of the Art

The problem of locating a lost ski in powder snow has long plagued skiers and has given rise to a service business by various individuals locating and recovering lost skis for a fee. However, efforts have been made to develop devices that will enable the skier, himself or herself, to immediately locate a ski lost under a covering of light powder snow and to consequently recover it immediately for continued skiing. One such device is in the form of a brightly colored cord securely fastened to the ski and loosely tucked into the clothing of the skier so as to trail along the slide path of the lost ski when the ski is freed from the boot and proceeds on its own to slide under the snow to an unpredictable location. Such device usually has a button at its free end that tends to rise to the surface even though the ski itself remains buried under the powder. At the surface, the button and cord are easily spotted visually by the skier, who can promptly recover the lost ski. However, such a device as heretofore constructed has interfered with the skier's maneuverability and has not always been effective for its intended purpose.

SUMMARY OF THE INVENTION

In accordance with the invention, a ski-locating device is constructed with an envelope containing a very long length of a colored streamer, preferably a ribbon, compactly bundled typically in a zig-zag manner within and transversely of the length of the envelope. One end of such streamer is adapted to be attached to the ski in one way or another as by means of a clip fitting adapted to snap onto a part of the ski or ski binding, while the other end within the envelope is free of any attachment, the envelope itself being adapted to be removably attached to the upper surface of the ski so it will be retained out of the way during skiing. Removable attachment of the envelope to the ski is preferably by easily releasable means, such as hook and loop pads (Velcro), one pad of which is secured to the upper surface of the ski and the other to the envelope for holding the envelope in place on the ski at such times as the skier wishes to ski in powder snow. Other easily-releasable fastening means, such as a set of snaps, could of course be used instead of the hook and loop pads, but less desirably so.

The envelope is typically attachable to the ski boot by a relatively short length of cord secured to the envelope at one end and provided with a clip fastener at its other end for snapping onto a part of the ski boot or into an auxiliary cord secured to the ski boot as by being looped around and secured to it.

THE DRAWINGS

The best mode presently contemplated for carrying out the invention commercially is illustrated in the accompanying drawings, in which:

FIG. 1 represents an enlarged perspective view showing how the device is used during skiing:

FIG. 2, a fragmentary, axial, vertical section taken through the envelope of FIG. 1, drawn to a larger scale and showing the bundled ribbon in elevation somewhat schematically, and FIG. 3 a view similar to that of FIG. 1 but showing the device extended to fulfill its intended purpose after a fall separates one of the skis from the ski boot.

DETAILED DESCRIPTION OF THE ILLUSTRATED EMBODIMENT

Figure 1:
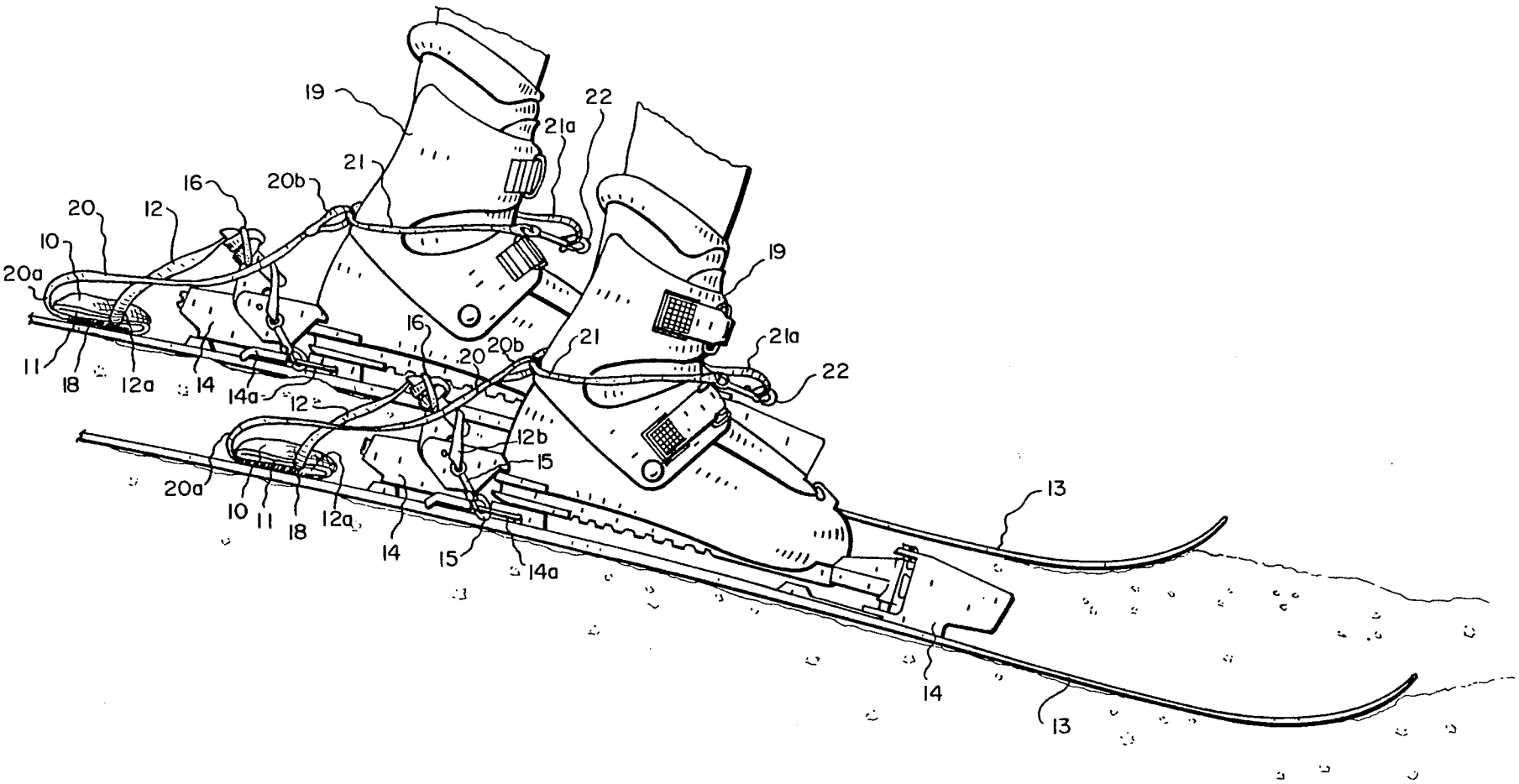
Figure 2:
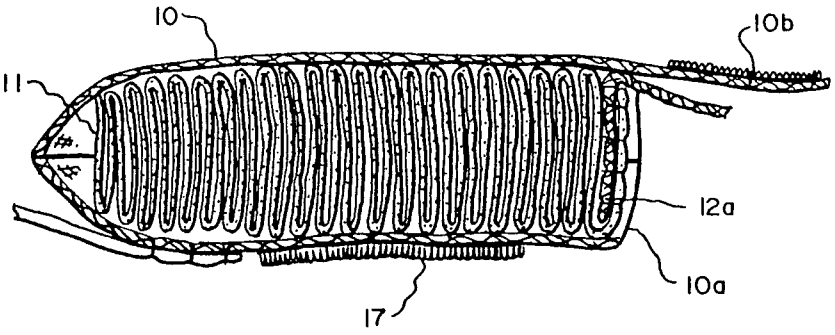

In its illustrated form, the device of the invention comprises an envelope 10 made of any suitable material, such as fabric or a preferably flexible plastic, for containing an elongate, bundled, colored streamer 11, which may be and preferably is a thin ribbon of colored flexible material As shown by FIG. 2, ribbon streamer 11 is preferably folded in zig-zag fashion transversely of the lengths of envelope 10 so as to form a compact bundle within the envelope. This is easily done by progressively pushing relatively short increments of the length of such streamer into the envelope through its open end 10*a*, which desirably has a covering flap 10*b*.

Streamer 11 at that open end has securely fastened thereto, as by sewing, an end 12*a* of a relatively short length 12 of cord or rope which is adapted to be fastened at its other end 12*b* to a part of a ski 13 or a standard, fall-releasable, ski boot binding 14 of such ski, as by a standard clip fitting 15 secured to such other end and 12*b* of cord or rope length 12, and, as here shown, removably snapped onto the brake portion 14*a* of the ski boot binding 14. Although cord or rope length 12 is made of minimum length, it is typically long enough to serve skis of varied lengths, so it may have to be shortened by doubling or otherwise bundling on itself at a convenient location intermediate its length, as shown, and secured in that condition by an ordinary elastic band 16.

Envelope 10 is provided with means for releasably fastening it to the surface of a ski being used by a skier, such means here being shown as one member 17, FIG. 2, of a set of quickly releasable, interconnecting members 17 and 18, respectively, preferably respective loop and hook pads as shown, the pad 18 being securely glued to the upper surface of the ski at a convenient location to the rear of the ski binding. Prior to installing envelope 10 on ski 13 for skiing in deep powder it may be necessary to brush snow or ice off pad 18 so pad 17 will attach to it. However, this can be avoided by attaching a covering part of such material (not shown) for ordinary skiing and removing it immediately prior to attaching the envelope of the device of the invention for skiing in deep powder.

The device of the invention includes means for attaching the envelope to the skier, preferably to the ski boot 19 being worn by the skier. As here shown, such means preferably takes the form of a length of cord or rope 20 having one end 20*a* secured as by sewing to envelope 10, preferably at the end thereof that is opposite the open end, and has its other end 20*b* adapted for attachment to ski boot 19 as by forming such other end 20*b* as a loop, as shown, and passing therethrough a length 21 of cord or rope that is adapted to be looped about the upper part of the boot 19 and secured in place by a clip fastener 22 at one end and a loop 21*a* or ring at the other end.

If the ski boot comes equipped with a ring or loop at its back, looped end 20*b* of cord or rope 20 may be replaced by a clip fastener for snapping directly onto such ring or loop carried by the boot.

Figure 3:
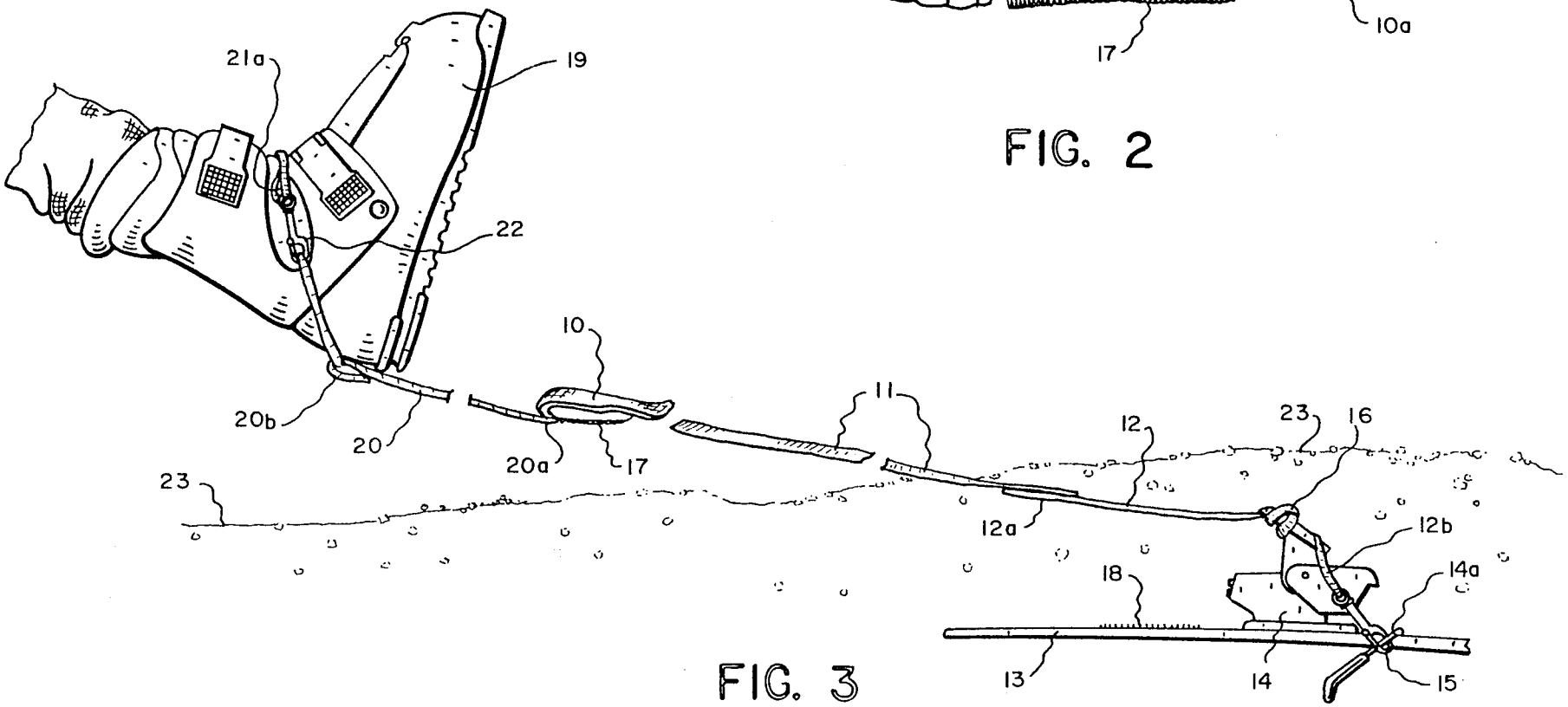

As indicated in FIG. 3, if and when the skier falls and his ski boot becomes disengaged from the ski boot binding while skiing in deep powder snow, streamer 11 will be progressively pulled free from its envelope and will tend to trail the free-running ski at the surface of the snow 23 where it can be easily seen by the skier so the ski can be promptly recovered.

Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A device for locating a lost ski in powdered snow while skiing, comprising an envelope open at one end and containing therewithin an elongate, colored streamer freely bundled in compact condition; means for releasably fastening said envelope to a ski worn by a skier with his or her ski boot held by a fall-releasable ski boot binding; and a first length of cord or rope having one end secured to an end of said streamer at the open end of said envelope and its other end adapted to be readily detachably secured to a part of said ski or ski boot binding; a second length of cord or rope having an end secured to said envelope and its other end adapted to be readily detachably secured to said ski boot.

2. A device according to claim 1, wherein the means for releasably fastening the envelope to a ski is at least one set of quickly releasable, interconnecting members, one member of which is secured to an outside surface of the envelope and the other member of which is adapted to be secured to a surface of the ski.

3. A device according to claim 2, wherein the elements are respective loop and hook pads.

4. A device according to claim 1, wherein the streamer is a ribbon folded compactly in zig-zag fashion.

5. A device according to claim 1, wherein the first cord or rope has a clip fitting secured to its other end for snapping onto a part of the ski or ski boot binding.

6. A device according to claim 5, where the second cord or rope has a loop at its other end for receiving a third cord or loop provided as part of said device and adapted to be securely looped around an upper part of the ski boot.

7. A device for locating a lost ski in powder snow while skiing, comprising an envelope open at one end and containing therewithin an elongate, colored streamer bundled in compact condition and entirely free at one end; means for releasably fastening said envelope to a ski worn by a skier with his ski boot held by a fall-releasable ski boot binding; means secured to an opposite end of the streamer and adapted to be readily detachably secured to said ski or ski boot binding; and another means secured to said envelope and adapted to be detachably secured to said ski boot.

* * * * *